US009890793B2

(12) United States Patent
Beers et al.

(10) Patent No.: US 9,890,793 B2
(45) Date of Patent: Feb. 13, 2018

(54) VARIABLE DIFFUSER VANE

(71) Applicant: Hamilton Sundstrand Corporation, Windsor Locks, CT (US)

(72) Inventors: Craig M. Beers, Wethersfield, CT (US); Murtuza Lokhandwalla, South Windsor, CT (US); Kevin M. Rankin, Windsor, CT (US); David A. Dorman, Feeding Hills, MA (US); Seth E. Rosen, Middletown, CT (US); John M. Beck, Windsor, CT (US); Paul E. Hamel, Enfield, CT (US); Clarence J. Wytas, Jr., Stafford Springs, CT (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 583 days.

(21) Appl. No.: 14/494,247

(22) Filed: Sep. 23, 2014

(65) Prior Publication Data

US 2016/0084264 A1 Mar. 24, 2016

(51) Int. Cl.

| | |
|---|---|
| ***F04D 29/46*** | (2006.01) |
| ***F04D 29/44*** | (2006.01) |
| ***F04D 17/10*** | (2006.01) |

(52) U.S. Cl.

CPC ..... *F04D 29/462* (2013.01); *F04D 17/10* (2013.01); *F04D 29/444* (2013.01)

(58) Field of Classification Search

CPC ..... F04D 29/462; F04D 29/444; F04D 29/46; F04D 29/464; F04D 29/24; F04D 29/242; F04D 29/245; F04D 29/30; F04D 29/247; F04D 17/10

USPC ..... 415/148, 159–164; 60/602

See application file for complete search history.

(56) References Cited

U.S. PATENT DOCUMENTS

| | | | | |
|---|---|---|---|---|
| 4,300,869 | A * | 11/1981 | Swearingen | F01D 17/165 415/160 |
| 7,140,839 | B2 | 11/2006 | McAuliffe et al. | |
| 7,407,367 | B2 | 8/2008 | McAuliffe et al. | |
| 8,777,561 | B2 | 7/2014 | Beers et al. | |
| 2003/0014972 | A1* | 1/2003 | Arnold | F01D 17/165 60/602 |
| 2006/0062666 | A1* | 3/2006 | McAuliffe | F04D 29/462 415/191 |
| 2006/0179839 | A1* | 8/2006 | Kuster | F04D 29/462 60/602 |

(Continued)

FOREIGN PATENT DOCUMENTS

| | | | | |
|---|---|---|---|---|
| GB | 2065235 | A * | 6/1981 | F04D 29/462 |

*Primary Examiner* — Gregory Anderson
*Assistant Examiner* — Danielle M Christensen
(74) *Attorney, Agent, or Firm* — Kinney & Lange, P.A.

(57) ABSTRACT

A vane for a variable diffuser includes a body with an inlet end and an outlet end, a leading surface extending from the inlet end to the outlet end, a trailing surface opposite the leading surface and extending from the inlet end to the outlet end, a first surface extending from the inlet end to the outlet end, and a second surface opposite the first surface and extending from the inlet end to the outlet end. The vane further includes a first cavity on the first surface of the vane adjacent the inlet end, a second cavity on the first surface of the vane adjacent the outlet end, a third cavity on the second surface of the vane adjacent the inlet end, and a fourth cavity on the second surface of the vane adjacent the outlet end.

15 Claims, 4 Drawing Sheets

(56) References Cited

U.S. PATENT DOCUMENTS

| | | | |
|---|---|---|---|
| 2012/0020776 | A1 | 1/2012 | Colson et al. |
| 2012/0114463 | A1 | 5/2012 | Beers et al. |

* cited by examiner

VARIABLE DIFFUSER VANE

BACKGROUND

The present disclosure relates to aircraft environmental control systems. More specifically, the present disclosure relates to a vane for a variable diffuser in a cabin air compressor.

Air cycle machines are used in environmental control systems in aircraft to condition air for delivery to an aircraft cabin. Conditioned air is air at a temperature, pressure, and humidity desirable for aircraft passenger comfort and safety. At or near ground level, the ambient air temperature and/or humidity is often sufficiently high that the air must be cooled as part of the conditioning process before being delivered to the aircraft cabin. At flight altitude, ambient air is often far cooler than desired, but at such a low pressure that it must be compressed to an acceptable pressure as part of the conditioning process. Compressing ambient air at flight altitude heats the resulting pressured air sufficiently that it must be cooled, even if the ambient air temperature is very low. Thus, under most conditions, heat must be removed from air by the air cycle machine before the air is delivered to the aircraft cabin.

A cabin air compressor can be used to compress air for use in an environmental control system. The cabin air compressor includes a motor to drive a compressor section that in turn compresses air flowing through the cabin air compressor. A variable diffuser is also positioned in the cabin air compressor. The variable diffuser has a plurality of vanes that are configured to pivot about a point in order to vary the size of a gap between adjacent vanes to vary the flow of air through the variable diffuser. The plurality of vanes on the variable diffuser are held between a shroud and a backing plate. A small clearance is typically provided between the shroud and the vanes and between the shroud and the backing plate, which can cause the vanes to float freely. Under unstable airflow conditions, the vanes may dither, vibrate, or resonate if they are floating freely. This can lead to significant wear between the vanes and the shroud and between the vanes and the backing plate and can also cause failure of the vanes.

SUMMARY

A vane for a variable diffuser includes a body with an inlet end and an outlet end, a leading surface extending from the inlet end to the outlet end, a trailing surface opposite the leading surface and extending from the inlet end to the outlet end, a first surface extending from the inlet end to the outlet end, and a second surface opposite the first surface and extending from the inlet end to the outlet end. The vane further includes a first cavity on the first surface of the vane adjacent the inlet end, a second cavity on the first surface of the vane adjacent the outlet end, a third cavity on the second surface of the vane adjacent the inlet end, and a fourth cavity on the second surface of the vane adjacent the outlet end.

DETAILED DESCRIPTION

Figure 1:
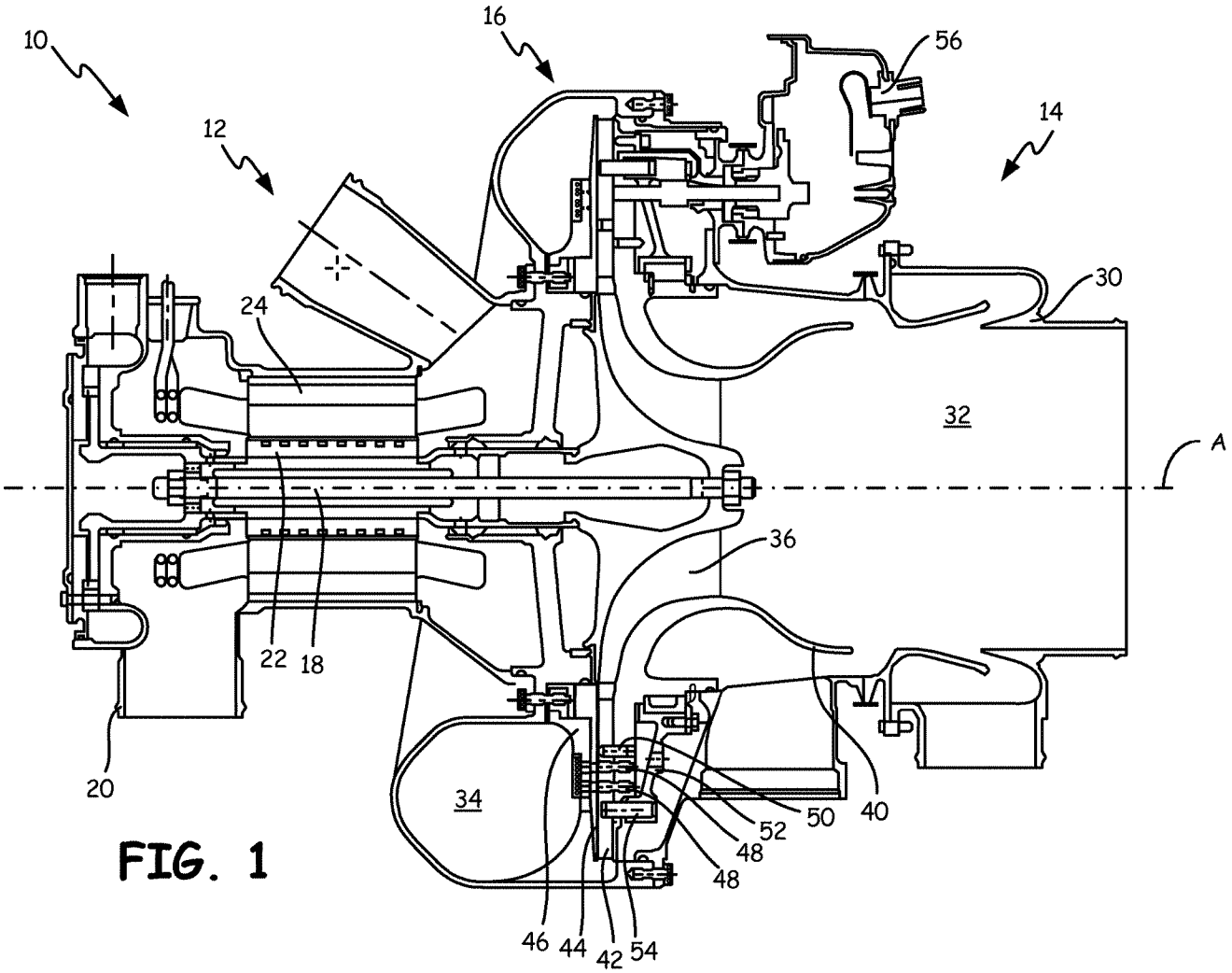
FIG. 1 is cross-sectional view of an air compressor.

FIG. 1 is cross-sectional view of air compressor 10. Air compressor 10 includes motor 12, compressor section 14, variable diffuser 16, and tie rod 18. Also shown in FIG. 1 is axis A. Motor 12 drives compressor section 14 in air compressor 10. Air will enter into compressor section 14 and then flow through variable diffuser 16 before exiting compressor section 14. Tie rod 18 extends through air compressor 10 and is centered on axis A. Motor 12 and compressor section 14 are mounted to tie rod 18. Motor 12 will drive tie rod 18 and cause it to rotate, which in turn will rotate compressor section 14.

Motor 12 includes motor housing 20, motor rotor 22, and motor stator 24. Motor housing 20 surrounds motor rotor 22 and motor stator 24. Motor 12 is an electric motor with motor rotor 22 disposed within motor stator 24. Motor rotor 22 is rotatable about axis A. Motor rotor 12 is mounted to tie rod 18 to drive rotation of tie rod 18 in air compressor 10.

Compressor section 14 includes compressor housing 30, compressor inlet 32, compressor outlet 34, and compressor rotor 36. Compressor housing 30 includes a duct that forms compressor inlet 32 and a duct that forms compressor outlet 34. Compressor inlet 32 draws air into compressor section 14. Positioned in compressor housing 30 is compressor rotor 36. Compressor rotor 36 is driven with motor 12 and is mounted on tie rod 18 to rotate with tie rod 18 about axis A. Air that is drawn into compressor section 14 through compressor inlet 32 is compressed with compressor rotor 36. The compressor air is then routed through variable diffuser 16 before exiting compressor section 14 through compressor outlet 34.

Variable diffuser 16 includes shroud 40, vanes 42, backing plate 44, mounting plate 46, fasteners 48, pivot pins 50, drive ring 52, drive pins 54, and diffuser actuator 56. Shroud 40 of variable diffuser 16 can be attached to compressor housing 30. Vanes 42 are positioned between shroud 40 and backing plate 44. Backing plate 44 is held against vanes 42 with mounting plate 46. Fasteners 48 extend through openings in mounting plate 46, backing plate 44, vanes 42, and shroud 40. Vanes 42 are positioned between shroud 40 and backing plate 44 so that there is a small clearance between vanes 42 and shroud 40 and between vanes 42 and backing plate 44.

Pivot pins 50 extend between openings in vanes 42 and openings in shroud 40. Vanes 42 can rotate about pivot pins 50. Drive ring 52 is positioned adjacent shroud 40. Drive pins 54 extend from drive ring 52 through shroud 40 into a slot in vanes 42. Drive ring 52 can be rotated about axis A with diffuser actuator 56. As drive ring 52 is rotated, drive pins 54 engaged in the slots in vanes 42 will drag vanes 42 and cause them to rotate about pivot pins 50. This movement of vanes 42 will vary the gap between adjacent vanes 42 to vary the amount of air flowing between vanes 42.

Varying the amount of air that flows between vanes 42 allows variable diffuser 16 to be used in different settings. First, when an aircraft is positioned on the ground the air that is taken into variable diffuser 16 is typically at a pressure that is suitable for use in the cabin. Vanes 42 can thus be positioned to allow air to flow through variable diffuser 16 without compressing the air. Alternatively, when an aircraft is in flight the air that is taken into variable diffuser 16 is typically at a low pressure that is unsuitable for use in the cabin. Vanes 42 can thus be positioned to compress the air flowing through variable diffuser 16 before that air is routed to an environmental control system.

Figure 2:
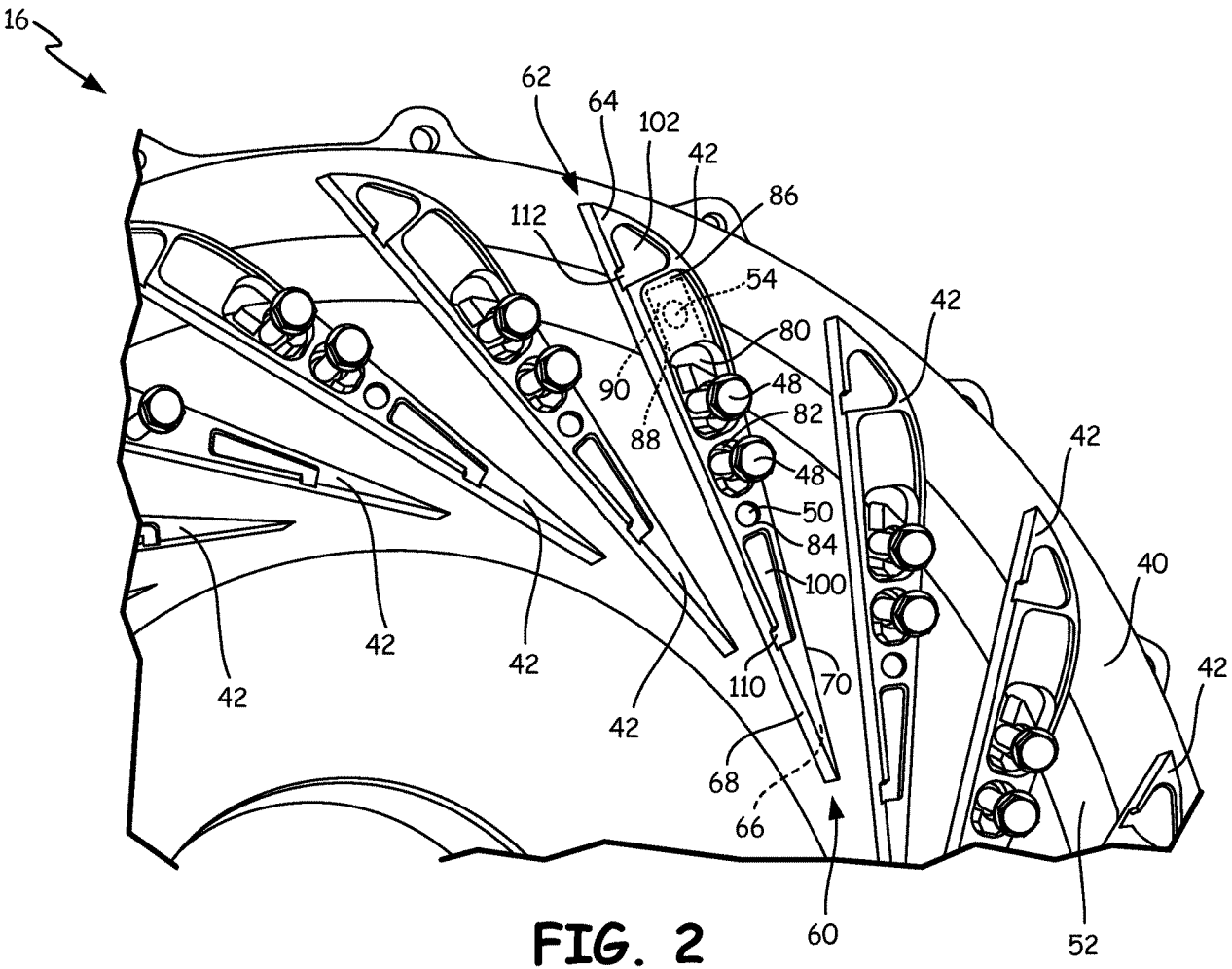
FIG. 2 is a perspective cut-away view of a variable diffuser.

FIG. 2 is a perspective cut-away view of variable diffuser 16. Variable diffuser 16 includes shroud 40, vanes 42, fasteners 48, pivot pins 50, drive ring 52, and drive pins 54. Each vane 42 includes inlet end 60, outlet end 62, first surface 64, second surface 66, leading surface 68, trailing surface 70, first aperture 80, second aperture 82, third aperture 84, first recess 86, second recess 88, slot 90, first cavity 100, second cavity 102, third cavity 104 (not shown in FIG. 2), fourth cavity 106 (not shown in FIG. 2), first notch 110, second notch 112, third notch 114 (not shown in FIG. 2), and fourth notch 116 (not shown in FIG. 2).

Variable diffuser 16 includes vanes 42 positioned on shroud 40. Fasteners 48 extend through a mounting plate (now shown in FIG. 2), a backing plate (not shown in FIG. 2), vanes 42, and shroud 40 to hold vanes 42 between the backing plate and shroud 40. Pivot pins 50 extend through vanes 42 and shroud 40 so that vanes 42 can pivot about pivot pins 50. Drive ring 52 is positioned adjacent shroud 40 and has a retaining ring that extends up to be flush with the surface of shroud 40 that abuts vanes 42. Drive pins 54 extend from drive ring 52 into vanes 42 to engage vanes 42. Drive ring 52 can be rotated, causing drive pins 54 to rotate vanes 42.

Vanes 42 are pivotally positioned in variable diffuser 16. Each vane 42 includes inlet end 60 positioned radially inward in relation to variable diffuser 16 and outlet end 62 positioned radially outward in relation to variable diffuser 16. Each vane 42 also includes first surface 64 and second surface 66 extending from inlet end 60 to outlet end 62. First surface 64 abuts the backing plate (now shown in FIG. 2) and second surface 64 abuts shroud 40. Each vane 42 also includes leading surface 68 and trailing surface 70 extending from inlet end 60 to outlet end 62. Leading surface 68 faces radially inward in relation to variable diffuser 16 and trailing surface 70 faces radially outward in relation to variable diffuser 16.

Each vane 42 includes first aperture 80 and second aperture 82 extending from first surface 64 to second surface 66. First aperture 80 receives one fastener 48 and second aperture 82 receives one fastener 48. First aperture 80 and second aperture 82 are sized so that first aperture 80 and second aperture 82 do not limit the movement of vane 42 when it pivots. A number of stand-offs can also be positioned in first aperture 80 and second aperture 82. The stand-offs are attached to shroud 40 and extend a slight distance over vanes 42 so that the backing plate does not rest on vanes 42. This allows for a small clearance between vanes 42 and shroud 40 and between vanes 42 and the backing plate.

Each vane 42 also includes third aperture 84 extending from first surface 64 to second surface 66. Third aperture 84 is sized to receive pivot pin 50. Vanes 42 pivot on pivot pins 50. Each vane 42 further includes first recess 86, second recess 88, and slot 90. First recess 86 is positioned on first surface 64 of vane 42. Second recess 88 is positioned on second surface 66 of vane 42. Second recess 88 is positioned around slot 90. Slot 90 extends a distance into vane 42 from second surface 66. Slot 90 is sized to slidably engage drive pin 54. As drive ring 52 rotates, drive pins 54 can slide through slots 90 to rotate vanes 42 about pivot pins 50.

Each vane 42 further includes first cavity 100, second cavity 102, third cavity 104, and fourth cavity 106. First cavity 100 and second cavity 102 are positioned on first surface 64. Third cavity 104 and fourth cavity 106 are positioned on second surface 66. Third cavity 104 and fourth cavity 106 are not shown in FIG. 2, as third cavity 104 is positioned below first cavity 100 on second surface 66 facing shroud 40 and fourth cavity 106 is positioned below second cavity 102 on second surface 66 facing shroud 40. Vane 42 further includes first notch 110, second notch 112, third notch 114, and fourth notch 116. First notch 110 in on first surface 64 and extends from leading surface 68 to first cavity 100. Second notch 112 is on first surface 64 and extends from leading surface 68 to second cavity 102. Third notch 114 is on second surface 66 and extends from trailing surface 70 to third cavity 104. Fourth notch 116 is on second surface 66 and extends from trailing surface 70 to fourth cavity 106. Third notch 114 and fourth notch 116 are not shown in FIG. 2, as they are positioned on second surface 66 facing shroud 40.

First cavity 110, second cavity 112, third cavity 114, and fourth cavity 116 are included on vane 42 to load vane 42 against the backing plate (now shown in FIG. 2) to prevent vanes 42 from dithering, vibrating, and resonating. First notch 110, second notch 112, third notch 114, and fourth notch 116 are included on vane 42 to vent first cavity 100, second cavity 102, third cavity 104, and fourth cavity 106, respectively. This allows air that is flowing through variable diffuser 16 to flow into first cavity 100, second cavity 102, third cavity 104, and fourth cavity 106 through first notch 110, second notch 112, third notch 114, and fourth notch 116, respectively. First cavity 100, second cavity 102, third cavity 104, and fourth cavity 106 are vented to different pressures to create the load that holds vane 42 against the backing plate.

Figure 3C:
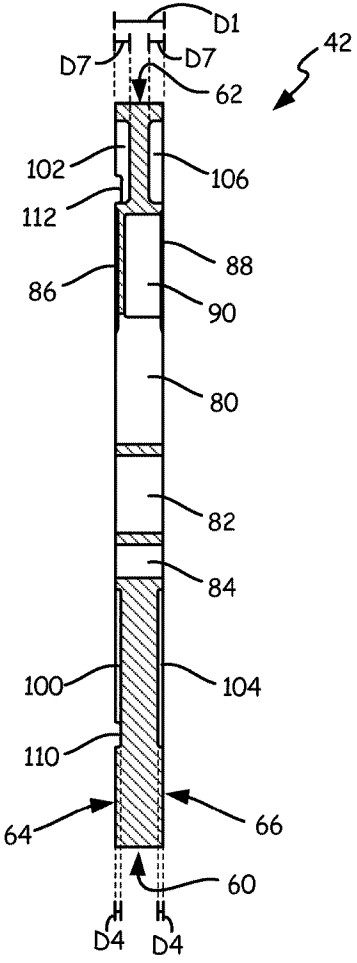
FIG. 3C is a cross-sectional view of the vane seen in FIG. 3A, taken along line 3C-3C of FIG. 3A.
Figure 3B:
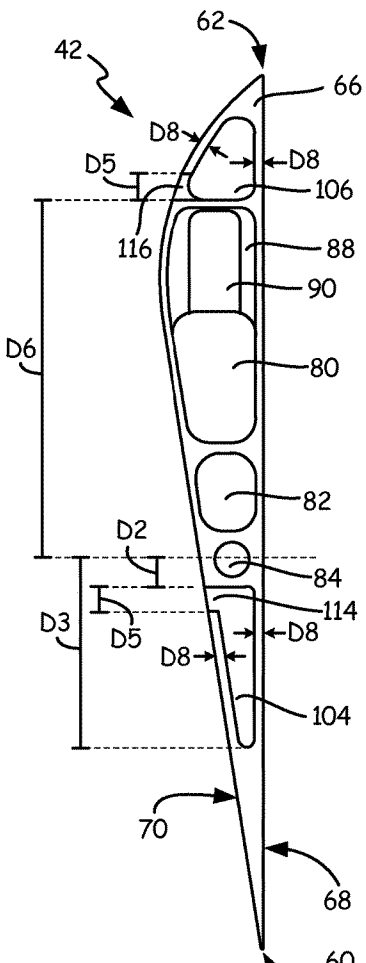
FIG. 3B is a back plan view of the vane seen in FIG. 3A.
Figure 3A:
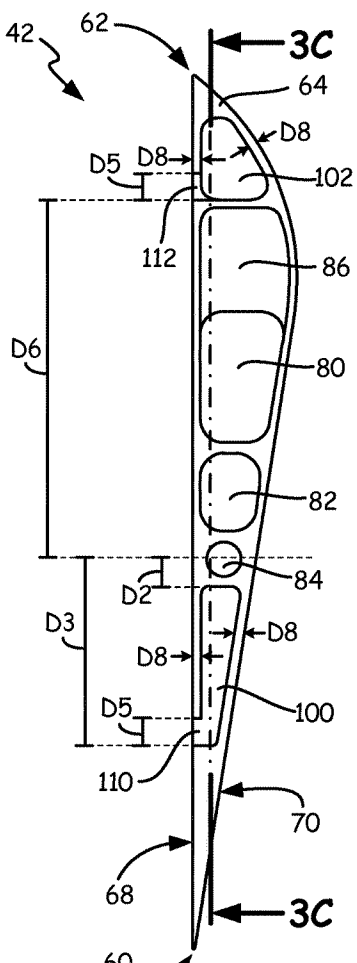
FIG. 3A is a front plan view of a vane from the variable diffuser.

FIG. 3A is a front plan view of vane 42 from variable diffuser 16. FIG. 3B is a back plan view of vane 42 seen in FIG. 3A. FIG. 3C is a cross-sectional view of vane 42 seen in FIG. 3A, taken along line 3C-3C of FIG. 3A. Vane 42 includes inlet end 60, outlet end 62, first surface 64, second surface 66, leading surface 68, trailing surface 70, first aperture 80, second aperture 82, third aperture 84, first recess 86, second recess 88, slot 90, first cavity 100, second cavity 102, third cavity 104, fourth cavity 106, first notch 110, second notch 112, third notch 114, and fourth notch 116.

Vane 42 includes inlet end 60 and outlet end 62. Vane 42 also includes first surface 64 and second surface 66 on opposite sides of vane 42 and extending from inlet end 60 to outlet end 62. Vane 42 also includes leading surface 68 and trailing surface 70 on opposite sides of vane 42 and extending from inlet end 60 to outlet end 62. Vane 42 further includes first aperture 80, second aperture 82, and third aperture 84. First aperture 80, second aperture 82, and third aperture 84 all extend through vane 42 from first surface 64 to second surface 66. Vane 42 further includes first recess 86, second recess 88, and slot 90. First recess 86 is positioned on first surface 64 of vane 42. Second recess 88 is positioned on second surface 66 of vane 42. Second recess 88 is positioned around slot 90. Slot 90 extends a distance into vane 42 from second surface 66.

Vane 42 includes first cavity 100, second cavity 102, third cavity 104, and fourth cavity 106. First cavity 100 and second cavity 102 are positioned on first surface 64. Third cavity 104 and fourth cavity 106 are positioned on second surface 66. First cavity 100, second cavity 102, third cavity 104, and fourth cavity 106 all have a triangular shape. Vane 42 further includes first notch 110, second notch 112, third notch 114, and fourth notch 116. First notch 110 in on first surface 64 and extends from leading surface 68 to first cavity 100. Second notch 112 is on first surface 64 and extends from leading surface 68 to second cavity 102. Third notch 114 is on second surface 66 and extends from trailing surface 70 to third cavity 104. Fourth notch 116 is on second surface 66 and extends from trailing surface 70 to fourth cavity 106.

Vane 42 has distance D1 between first surface 64 and second surface 66. Distance D1 is between 0.345 inches and 0.347 inches. First cavity 100 of vane 42 is positioned between inlet end 60 of vane 42 and third aperture 84. First cavity 100 has a first edge that is distance D2 away from a center of third aperture 84. Distance D2 is between 0.196 inches and 0.216 inches. First cavity 100 has a second edge that is distance D3 away from a center of third aperture 84. Distance D3 is between 1.347 inches and 1.367 inches. First cavity 100 extends distance D4 into vane 42. Distance D4 is between 0.030 inches and 0.050 inches. First notch 110 is positioned near the second edge of first cavity 100 adjacent inlet end 60 of vane 42. Distance D5 is the distance between a first edge of first notch 110 and a second edge of first notch 110. Distance D5 is between 0.178 inches and 0.198 inches.

Second cavity 102 of vane 42 is positioned between outlet end 62 of vane 42 and first recess 86. Second cavity 102 has a first edge that is distance D6 away from a center of third aperture 84. Distance D6 is between 2.630 inches and 2.650 inches. Second cavity 102 extends distance D7 into vane 42. Distance D7 is between 0.090 inches and 0.110 inches. Second notch 112 is positioned near the first edge of second cavity 102 adjacent first recess 86. Distance D5 is the distance between a first edge of second notch 112 and a second edge of second notch 112. Distance D5 is between 0.178 inches and 0.198 inches.

Third cavity 104 of vane 42 is positioned between inlet end 60 of vane 42 and third aperture 84. Third cavity 104 has a first edge that is distance D2 away from a center of third aperture 84. Distance D2 is between 0.196 inches and 0.216 inches. Third cavity 104 has a second edge that is distance D3 away from a center of third aperture 84. Distance D3 is between 1.347 inches and 1.367 inches. Third cavity 104 extends distance D4 into vane 42. Distance D4 is between 0.030 inches and 0.050 inches. Third notch 114 is positioned near the first edge of third cavity 104 adjacent third aperture 84. Distance D5 is the distance between a first edge of third notch 114 and a second edge of third notch 114. Distance D5 is between 0.178 inches and 0.198 inches.

Fourth cavity 106 of vane 42 is positioned between outlet end 62 of vane 42 and second recess 88. Fourth cavity 106 has a first edge that is distance D6 away from a center of third aperture 84. Distance D6 is between 2.630 inches and 2.650 inches. Fourth cavity 106 extends distance D7 into vane 42. Distance D7 is between 0.090 inches and 0.110 inches. Fourth notch 116 is positioned near the first edge of fourth cavity 116 adjacent second recess 88. Distance D5 is the distance between a first edge of fourth notch 116 and a second edge of fourth notch 116. Distance D5 is between 0.178 inches and 0.198 inches.

Vane 42 also includes distance D8. Distance D8 is the distance between leading surface 68 and a first side of first cavity 100; the distance between trailing surface 70 and a second side of first cavity 100; the distance between leading surface 68 and a first side of second cavity 102; the distance between trailing surface 70 and a second side of second cavity 102; the distance between trailing surface 70 and a first side of third cavity 104; the distance between leading surface 68 and a second side of third cavity 104; the distance between trailing surface 70 and a first side of fourth cavity 106; and the distance between leading surface 68 and a second side of fourth cavity 106. Distance D8 is between 0.060 inches and 0.080 inches.

Table 1 below is a list of different ratios of distances D1-D8.

TABLE 1

A list of ratios of distances D1-D8.

| Ratio | Minimum | Maximum |
|---|---|---|
| D1/D2 | 1.597 | 1.770 |
| D1/D3 | 0.252 | 0.258 |
| D1/D4 | 6.900 | 11.567 |
| D1/D5 | 1.742 | 1.949 |
| D1/D6 | 0.130 | 0.132 |
| D1/D7 | 3.136 | 3.856 |
| D1/D8 | 4.313 | 5.783 |
| D2/D3 | 0.143 | 0.160 |
| D2/D8 | 2.450 | 3.600 |
| D3/D5 | 6.803 | 7.680 |
| D3/D8 | 16.838 | 22.783 |
| D6/D8 | 32.875 | 44.167 |

Figure 4A:
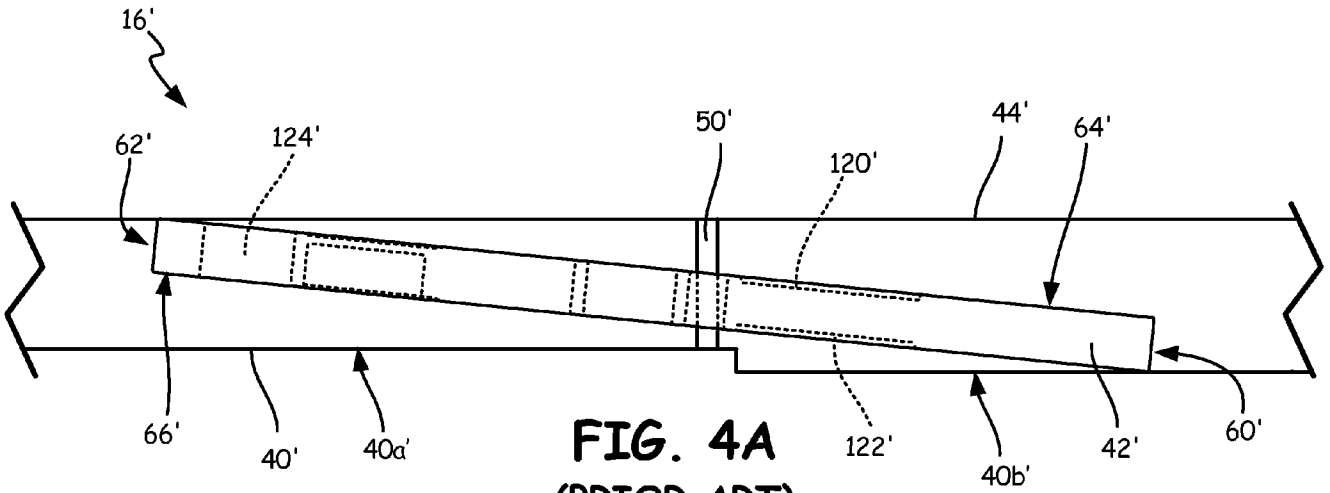
FIG. 4A (PRIOR ART)
FIG. 4A is a cross-sectional view of a prior art vane between a shroud and a backing plate in the variable diffuser.

FIG. 4A is a cross-sectional view of prior art vane 42' between shroud 40' and backing plate 44' in variable diffuser 16'. Variable diffuser 16' includes shroud 40', vane 42', backing plate 44', and pivot pin 50'. Vane 42' includes inlet end 60', outlet end 62', first surface 64', second surface 66', first cavity 120', second cavity 122', and aperture 124'.

Shroud 40' has milled portion 40*a*' that is manufactured with a milling process and turned portion 40*b*' that is manufactured with a turning process. There is a small step between milled portion 40*a*' and turned portion 40*b*' of shroud 40' due to the different manufacturing processes. Vane 42' is positioned between shroud 40' and backing plate 44' with a small clearance between vane 42' and shroud 40' and between vane 42' and backing plate 44'. Pivot pin 50' extends from shroud 40' through vane 42' so that vane 42' can pivot about pivot pin 50'.

Vane 42' includes inlet end 60' and outlet end 62'. Air flowing through variable diffuser 16' will flow across vane 42' from inlet end 60' to outlet end 62'. Vane 42' also includes first surface 64' that abuts backing plate 44' and second surface 66' that abuts shroud 40'. Prior art vane 42' includes first cavity 120', second cavity 122', and aperture 124'. First cavity 120' and second cavity 122' are positioned adjacent to inlet end 60'. First cavity 120' is on first surface 64' and second cavity 122' is on second surface 66'. Aperture 124' is positioned adjacent to outlet end 62' and extends from first surface 64' to second surface 66'.

As air flows through variable diffuser 16' and across vane 42', air will flow into first cavity 120' and second cavity 122'. First cavity 120' and second cavity 122' each have a notch that extends from a side surface of vane 42' into first cavity 120' or second cavity 122' to vent first cavity 120' and second cavity 122'. First cavity 120' and second cavity 122' can be vented to different pressures to create a load on vane 42'. First cavity 120' with have a high pressure and second cavity 122' will have a low pressure. This difference in pressure will create a load that holds vane 42' against shroud 40'. Loading vane 42' against shroud 40' will prevent vane 42' from free floating, and in turn dithering, vibrating, and resonating, between shroud 40' and backing plate 44'.

One problem present with prior art vane 42' is that the difference in pressure between first cavity 120' and second cavity 122' will create a overturning moment that will cause vane 42' to tilt between shroud 40' and backing plate 44'. Aperture 124' at the opposite end of vane 42' will not put a load on vane 42', as air will not gather and create a pressure in aperture 124'. As vane 42' tilts due to the overturning moment, a first tip of vane 42' adjacent inlet end 60' will come into contact with shroud 40' and create a point load on shroud 40'. Additionally, a second tip of vane 42' adjacent outlet end 62' will come into contact with backing plate 44' and create a point load at backing plate 44'. The point loads on shroud 40' and backing plate 44' will cause significant wear between vane 42' and shroud 40' and between vane 42' and backing plate 44'. Further, the tilt created on vane 42' will cause vane 42' to be more susceptible to dithering, vibrating, and resonating in unstable flow conditions. This can wear vane 42' and cause vane 42' to fail.

Figure 4B:
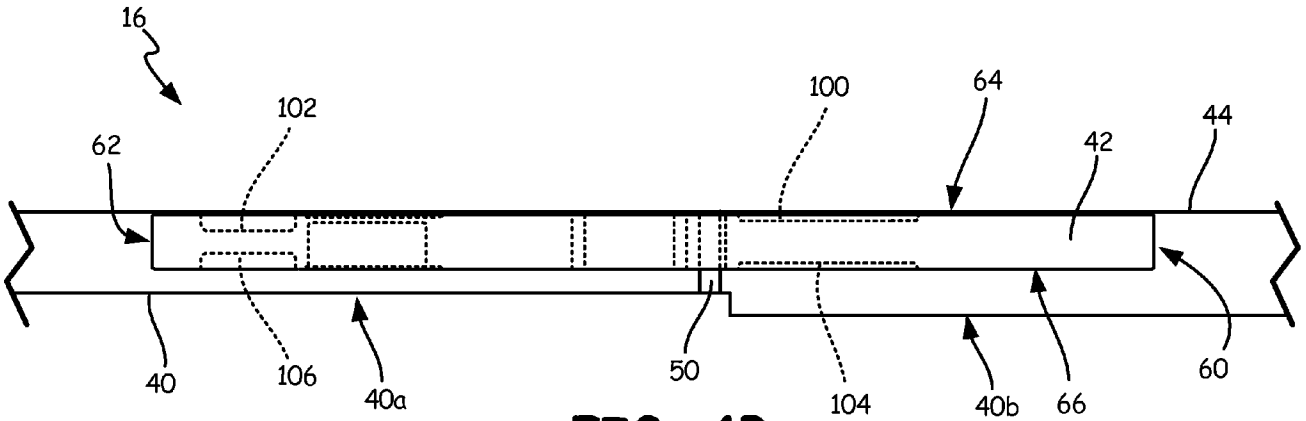
FIG. 4B is a cross-sectional view of the vane according to the present disclosure between a shroud and a backing plate in the variable diffuser.

FIG. 4B is a cross-sectional view of vane 42 according to the present disclosure between shroud 40 and backing plate 44 in variable diffuser 16. Variable diffuser 16 includes shroud 40, vane 42, backing plate 44, and pivot pin 50. Vane 42 includes inlet end 60, outlet end 62, first surface 64, second surface 66, first cavity 100, second cavity 102, third cavity 104, and fourth cavity 106.

Shroud 40 has milled portion 40*a* that is manufactured with a milling process and turned portion 40*b* that is manufactured with a turning process. There is a small step between milled portion 40*a* and turned portion 40*b* of shroud 40 due to the different manufacturing processes. Vane 42 is positioned between shroud 40 and backing plate 44 with a small clearance between vane 42 and shroud 40 and between vane 42 and backing plate 44. Pivot pin 50 extends from shroud 40 through vane 42 so that vane 42 can pivot around pivot pin 50.

Vane 42 includes inlet end 60 and outlet end 62. Air flowing through variable diffuser 16 will flow across vane 42 from inlet end 60 to outlet end 62. Vane 42 also includes first surface 64 that abuts backing plate 44 and second surface 66 that abuts shroud 40. Vane 42 according to the present disclosure includes first cavity 100, second cavity 102, third cavity 104, and fourth cavity 106. First cavity 100 and third cavity 104 are positioned adjacent to inlet end 60. First cavity 100 is on first surface 64 and third cavity 104 is on second surface 66. Second cavity 102 and fourth cavity 106 are positioned adjacent to outlet end 62. Second cavity 102 is on first surface 64 and fourth cavity 106 is on second surface 66.

As air flows through variable diffuser 16 and across vane 42, air will flow into first cavity 100, second cavity 102, third cavity 104, and fourth cavity 106. First cavity 100, second cavity 102, third cavity 104, and fourth cavity 106 each have a notch that extends from a side surface of vane 42 into first cavity 100, second cavity 102, third cavity 104, and fourth cavity 106 to vent each of first cavity 100, second cavity 102, third cavity 104, and fourth cavity 106. First cavity 100, second cavity 102, third cavity 104, and fourth cavity 106 can all be vented to different pressures to create a load on vane 42. First cavity 100 and second cavity 102 will have a low pressure and third cavity 104 and fourth cavity 106 will have a high pressure. This difference in pressure will create a load that holds vane 42 against backing plate 44. Loading vane 42 against backing plate 44 will prevent vane 42 from free floating, and in turn dithering, vibrating, and resonating, between shroud 40 and backing plate 44.

Vane 42 according to the present disclosure is advantageous over prior art vanes. Vane 42 loads against backing plate 44. Backing plate 44 is a flat surface compared to shroud 40 that has a step between milled surface 40*a* and turned surface 40*b*. Loading vane 42 against the flat surface of backing plate 44 is advantageous, as it allows vane 42 to abut backing plate 44 across the entirety of first surface 64 of vane 42. In alternate embodiments, vane 42 can also be designed to be loaded against shroud 40 if shroud 40 was manufactured as a flat surface without the step between milled surface 40*a* and turned surface 40*b*.

Further, providing second cavity 102 and fourth cavity 106 helps to balance the load put on vane 42. Second cavity 102 and fourth cavity 106 can gather air and create a pressure in each of second cavity 102 and fourth cavity 106 adjacent outlet end 62 of vane 42. The pressures in second cavity 102 and fourth cavity 106 will balance the pressures in first cavity 100 and third cavity 104 to create a uniform load across vane 42. This prevent vanes 42 from tilting between shroud 40 and backing plate 44, as the overturning moment is eliminated with the addition of second cavity 102 and fourth cavity 106. Further, the uniform load on vane 42 will distribute forces from vane 42 against backing plate 44 and decrease point loading between vane 42 and backing plate 44. This will prevent vane 42 from wearing on backing plate 44, allowing both parts to maintain structural integrity for a longer period of time before having to be replaced.

Discussion of Possible Embodiments

The following are non-exclusive descriptions of possible embodiments of the present invention.

A vane for a variable diffuser includes a body with an inlet end and an outlet end, a leading surface extending from the inlet end to the outlet end, a trailing surface opposite the leading surface and extending from the inlet end to the outlet end, a first surface extending from the inlet end to the outlet end, and a second surface opposite the first surface and extending from the inlet end to the outlet end. The vane further includes a first cavity on the first surface of the vane adjacent the inlet end, a second cavity on the first surface of the vane adjacent the outlet end, a third cavity on the second surface of the vane adjacent the inlet end, and a fourth cavity on the second surface of the vane adjacent the outlet end.

The vane of the preceding paragraph can optionally include, additionally and/or alternatively, any one or more of the following features, configurations and/or additional components:

The vane further includes a first notch in the first surface extending from the leading surface to the first cavity, a second notch in the first surface extending from the leading surface to the second cavity, a third notch in the second surface extending from the trailing surface to the third cavity, and a fourth notch in the second surface extending from the trailing surface to the fourth cavity.

A ratio of a distance from the first surface to the second surface of the vane and a distance from a first edge to a second edge of the first notch is between 1.742 and 1.949.

A ratio of a distance from the first surface to the second surface of the vane and a distance from a first edge to a second edge of the second notch is between 1.742 and 1.949.

A ratio of a distance from the first surface to the second surface of the vane and a distance from a first edge to a second edge of the third notch is between 1.742 and 1.949.

A ratio of a distance from the first surface to the second surface of the vane and a distance from a first edge to a second edge of the fourth notch is between 1.742 and 1.949.

A ratio of a distance from the first surface to the second surface of the vane and a distance from the first surface to a surface of the first cavity is between 6.900 and 11.567.

A ratio of a distance from the first surface to the second surface of the vane and a distance from the second surface to a surface of the third cavity is between 6.900 and 11.567.

A ratio of a distance from the first surface to the second surface of the vane and a distance from the first surface to a surface of the second cavity is between 3.136 and 3.856.

A ratio of a distance from the first surface to the second surface of the vane and a distance from the second surface to a surface of the fourth cavity is between 3.136 and 3.856.

The vane further includes an aperture in the body upon which the vane pivots, wherein the aperture extends from the first surface to the second surface, and wherein the aperture is positioned between the inlet end and the outlet end.

A ratio of a distance from the center of the aperture to a first end of the first cavity and a distance from the leading surface to a first side of the first cavity is between 2.450 and 3.600.

A ratio of a distance from the center of the aperture to a first end of the first cavity and a distance from the trailing surface to a second side of the first cavity is between 2.450 and 3.600.

A ratio of a distance from the center of the aperture to a first end of the third cavity and a distance from the leading surface to a first side of the third cavity is between 2.450 and 3.600.

A ratio of a distance from the center of the aperture to a first end of the third cavity and a distance from the trailing surface to a second side of the third cavity is between 2.450 and 3.600.

A ratio of a distance from the center of the aperture to a first end of the second cavity and a distance from the leading surface to a first side of the second cavity is between 32.875 and 44.167.

A ratio of a distance from the center of the aperture to a first end of the second cavity and a distance from the trailing surface to a second side of the second cavity is between 32.875 and 44.167.

A ratio of a distance from the center of the aperture to a first end of the fourth cavity and a distance from the leading surface to a first side of the fourth cavity is between 32.875 and 44.167.

A ratio of a distance from the center of the aperture to a first end of the fourth cavity and a distance from the trailing surface to a second side of the fourth cavity is between 32.875 and 44.167.

A ratio of a distance between from the first surface to the second surface of the vane and a distance from the center of the aperture to a first end of the first cavity is between 1.597 and 1.770.

A ratio of a distance between from the first surface to the second surface of the vane and a distance from the center of the aperture to a first end of the third cavity is between 1.597 and 1.770.

A ratio of a distance between from the first surface to the second surface of the vane and a distance from the center of the aperture to a first end of the second cavity is between 0.130 and 0.132.

A ratio of a distance between from the first surface to the second surface of the vane and a distance from the center of the aperture to a first end of the fourth cavity is between 0.130 and 0.132.

A variable diffuser includes a shroud, a backing plate, and a plurality of vanes positioned between the shroud and the backing plate and pivotally connected to the shroud. Each vane includes an inlet end, an outlet end, a first surface adjacent to the shroud, a second surface adjacent to the backing plate, a leading surface extending from the inlet end to the outlet end, and a trailing surface extending from the inlet end to the outlet end. Each vane also includes a first cavity on the first surface of the vane adjacent the inlet end, a second cavity on the first surface of the vane adjacent the outlet end, a third cavity on the second surface of the vane adjacent the inlet end, and a fourth cavity on the second surface of the vane adjacent the outlet end.

The variable diffuser of the preceding paragraph can optionally include, additionally and/or alternatively, any one or more of the following features, configurations and/or additional components:

The variable diffuser further includes a first notch in the first surface extending from the leading surface to the first cavity, a second notch in the first surface extending from the leading surface to the second cavity, a third notch in the second surface extending from the trailing surface to the third cavity, and a fourth notch in the second surface extending from the trailing surface to the fourth cavity.

Each vane further includes a first aperture configured to receive a pivot pin, wherein the aperture extends from the first surface to the second surface, a second aperture configured to receive a fastener to connect the shroud to the backing plate, wherein the second aperture extends from the first surface to the second surface, and a third aperture configured to receive a fastener to connect the shroud to the backing plate, wherein the third aperture extends from the first surface to the second surface.

A ratio of a distance from the center of the first aperture to a first end of the first cavity and a distance from the leading surface to a first side of the first cavity is between 2.450 and 3.600.

A ratio of a distance from the center of the first aperture to a first end of the first cavity and a distance from the trailing surface to a second side of the first cavity is between 2.450 and 3.600.

A ratio of a distance from the center of the first aperture to a first end of the third cavity and a distance from the leading surface to a first side of the third cavity is between 2.450 and 3.600.

A ratio of a distance from the center of the first aperture to a first end of the third cavity and a distance from the trailing surface to a second side of the third cavity is between 2.450 and 3.600.

A ratio of a distance from the center of the first aperture to a first end of the second cavity and a distance from the leading surface to a first side of the second cavity is between 32.875 and 44.167.

A ratio of a distance from the center of the first aperture to a first end of the second cavity and a distance from the trailing surface to a second side of the second cavity is between 32.875 and 44.167.

A ratio of a distance from the center of the first aperture to a first end of the fourth cavity and a distance from the leading surface to a first side of the fourth cavity is between 32.875 and 44.167.

A ratio of a distance from the center of the first aperture to a first end of the fourth cavity and a distance from the trailing surface to a second side of the fourth cavity is between 32.875 and 44.167.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A vane for a variable diffuser, the vane comprising:

a body with an inlet end and an outlet end, a leading surface extending from the inlet end to the outlet end, a trailing surface opposite the leading surface and extending from the inlet end to the outlet end, a first surface extending from the inlet end to the outlet end, and a second surface opposite the first surface and extending from the inlet end to the outlet end;

a first cavity on the first surface of the vane adjacent the inlet end;

a second cavity on the first surface of the vane adjacent the outlet end;

a third cavity on the second surface of the vane adjacent the inlet end; and a fourth cavity on the second surface of the vane adjacent the outlet end;

wherein a distance from the first surface to a surface of the first cavity is equal to a distance from the second surface to a surface of the third cavity;

wherein a distance from the first surface to a surface of the second cavity is equal to a distance from the second surface to a surface of the fourth cavity; and wherein the distance from the first surface to the surface of the first cavity and the distance from the second surface to the surface of the third cavity is smaller than the distance from the first surface to the surface of the second cavity and the distance from the second surface to the surface of the fourth cavity.

2. The vane of claim 1, and further comprising:

a first notch in the first surface extending from the leading surface to the first cavity;

a second notch in the first surface extending from the leading surface to the second cavity;

a third notch in the second surface extending from the trailing surface to the third cavity; and a fourth notch in the second surface extending from the trailing surface to the fourth cavity.

3. The vane of claim 2, wherein:

a ratio of a distance from the first surface to the second surface of the vane and a distance from a first edge to a second edge of the first notch is between 1.742 and 1.949;

a ratio of a distance from the first surface to the second surface of the vane and a distance from a first edge to a second edge of the second notch is between 1.742 and 1.949;

a ratio of a distance from the first surface to the second surface of the vane and a distance from a first edge to a second edge of the third notch is between 1.742 and 1.949; and a ratio of a distance from the first surface to the second surface of the vane and a distance from a first edge to a second edge of the fourth notch is between 1.742 and 1.949.

4. The vane of claim 1, wherein:

a ratio of a distance from the first surface to the second surface of the vane and a distance from the first surface to the surface of the first cavity is between 6.900 and 11.567; and a ratio of a distance from the first surface to the second surface of the vane and a distance from the second surface to the surface of the third cavity is between 6.900 and 11.567.

5. The vane of claim 1, wherein:

a ratio of a distance from the first surface to the second surface of the vane and a distance from the first surface to the surface of the second cavity is between 3.136 and 3.856; and a ratio of a distance from the first surface to the second surface of the vane and a distance from the second surface to the surface of the fourth cavity is between 3.136 and 3.856.

6. The vane of claim 1, and further comprising:

an aperture in the body upon which the vane pivots, wherein the aperture extends from the first surface to the second surface, and wherein the aperture is positioned between the inlet end and the outlet end.

7. The vane of claim 6, wherein:

a ratio of a distance from the center of the aperture to a first end of the first cavity and a distance from the leading surface to a first side of the first cavity is between 2.450 and 3.600;

a ratio of a distance from the center of the aperture to a first end of the first cavity and a distance from the trailing surface to a second side of the first cavity is between 2.450 and 3.600;

a ratio of a distance from the center of the aperture to a first end of the third cavity and a distance from the leading surface to a first side of the third cavity is between 2.450 and 3.600; and a ratio of a distance from the center of the aperture to a first end of the third cavity and a distance from the trailing surface to a second side of the third cavity is between 2.450 and 3.600.

8. The vane of claim 6, wherein:

a ratio of a distance from the center of the aperture to a first end of the second cavity and a distance from the leading surface to a first side of the second cavity is between 32.875 and 44.167;

a ratio of a distance from the center of the aperture to a first end of the second cavity and a distance from the trailing surface to a second side of the second cavity is between 32.875 and 44.167;

a ratio of a distance from the center of the aperture to a first end of the fourth cavity and a distance from the leading surface to a first side of the fourth cavity is between 32.875 and 44.167; and a ratio of a distance from the center of the aperture to a first end of the fourth cavity and a distance from the trailing surface to a second side of the fourth cavity is between 32.875 and 44.167.

9. The vane of claim 6, wherein:

a ratio of a distance between from the first surface to the second surface of the vane and a distance from the center of the aperture to a first end of the first cavity is between 1.597 and 1.770; and a ratio of a distance between from the first surface to the second surface of the vane and a distance from the center of the aperture to a first end of the third cavity is between 1.597 and 1.770.

10. The vane of claim 6, wherein:

a ratio of a distance between from the first surface to the second surface of the vane and a distance from the center of the aperture to a first end of the second cavity is between 0.130 and 0.132; and a ratio of a distance between from the first surface to the second surface of the vane and a distance from the center of the aperture to a first end of the fourth cavity is between 0.130 and 0.132.

11. A variable diffuser comprising:

a shroud;

a backing plate; and a plurality of vanes positioned between the shroud and the backing plate and pivotally connected to the shroud, wherein each vane in the plurality of vanes comprises:

an inlet end;

an outlet end;

a first surface adjacent to the shroud;

a second surface adjacent to the backing plate;

a leading surface extending from the inlet end to the outlet end;

a trailing surface extending from the inlet end to the outlet end;

a first cavity on the first surface of the vane adjacent the inlet end;

a second cavity on the first surface of the vane adjacent the outlet end;

a third cavity on the second surface of the vane adjacent the inlet end; and a fourth cavity on the second surface of the vane adjacent the outlet end;

wherein a distance from the first surface to a surface of the first cavity is equal to a distance from the second surface to a surface of the third cavity;

wherein a distance from the first surface to a surface of the second cavity is equal to a distance from the second surface to a surface of the fourth cavity; and wherein the distance from the first surface to the surface of the first cavity and the distance from the second surface to the surface of the third cavity is smaller than the distance from the first surface to the surface of the second cavity and the distance from the second surface to the surface of the fourth cavity.

12. The variable diffuser of claim 11, and further comprising:

a first notch in the first surface extending from the leading surface to the first cavity;

a second notch in the first surface extending from the leading surface to the second cavity;

a third notch in the second surface extending from the trailing surface to the third cavity; and a fourth notch in the second surface extending from the trailing surface to the fourth cavity.

13. The variable diffuser of claim 11, wherein each vane further comprises:

a first aperture configured to receive a pivot pin, wherein the first aperture extends from the first surface to the second surface;

a second aperture configured to receive a fastener to connect the shroud to the backing plate, wherein the second aperture extends from the first surface to the second surface; and a third aperture configured to receive a fastener to connect the shroud to the backing plate, wherein the third aperture extends from the first surface to the second surface.

14. The variable diffuser of claim 13, wherein:

a ratio of a distance from the center of the first aperture to a first end of the first cavity and a distance from the leading surface to a first side of the first cavity is between 2.450 and 3.600;

a ratio of a distance from the center of the first aperture to a first end of the first cavity and a distance from the trailing surface to a second side of the first cavity is between 2.450 and 3.600;

a ratio of a distance from the center of the first aperture to a first end of the third cavity and a distance from the leading surface to a first side of the third cavity is between 2.450 and 3.600; and a ratio of a distance from the center of the first aperture to a first end of the third cavity and a distance from the trailing surface to a second side of the third cavity is between 2.450 and 3.600.

15. The variable diffuser of claim 13, wherein:

a ratio of a distance from the center of the first aperture to a first end of the second cavity and a distance from the leading surface to a first side of the second cavity is between 32.875 and 44.167;

a ratio of a distance from the center of the first aperture to a first end of the second cavity and a distance from the trailing surface to a second side of the second cavity is between 32.875 and 44.167;

a ratio of a distance from the center of the first aperture to a first end of the fourth cavity and a distance from the leading surface to a first side of the fourth cavity is between 32.875 and 44.167; and a ratio of a distance from the center of the first aperture to a first end of the fourth cavity and a distance from the trailing surface to a second side of the fourth cavity is between 32.875 and 44.167.

* * * * *